US008850739B2

(12) United States Patent
Kennedy

(10) Patent No.: US 8,850,739 B2
(45) Date of Patent: Oct. 7, 2014

(54) PATRIDGE SIGHTS AND RELATED METHODS

(71) Applicant: Brad Kennedy, San Diego, CA (US)

(72) Inventor: Brad Kennedy, San Diego, CA (US)

( * ) Notice: Subject to any disclaimer, the term of this patent is extended or adjusted under 35 U.S.C. 154(b) by 0 days.

(21) Appl. No.: 13/725,410

(22) Filed: Dec. 21, 2012

(65) Prior Publication Data

US 2014/0173965 A1 Jun. 26, 2014

(51) Int. Cl.
*F41G 1/16* (2006.01)

(52) U.S. Cl.
CPC ..... *F41G 1/16* (2013.01)
USPC ..... 42/135

(58) Field of Classification Search
USPC ..... 42/111, 133–142
See application file for complete search history.

(56) References Cited

U.S. PATENT DOCUMENTS

| | | | |
|---|---|---|---|
| 4,479,307 | A | 10/1984 | Pomeranz |
| 6,112,422 | A | 9/2000 | Laiche |
| 7,743,546 | B2 | 6/2010 | Keng |
| 8,069,607 | B2 | 12/2011 | Ballard |
| 2008/0276519 | A1 | 11/2008 | Ballard |

OTHER PUBLICATIONS

PCT ISR PCT/US2013/077316.

*Primary Examiner* — Reginald Tillman, Jr.
(74) *Attorney, Agent, or Firm* — John K. Buche; Buche & Associates, P.C.

(57) ABSTRACT

Disclosed is an improved open sight that may be operated as a Patridge sight and point-on-point sight.

4 Claims, 9 Drawing Sheets

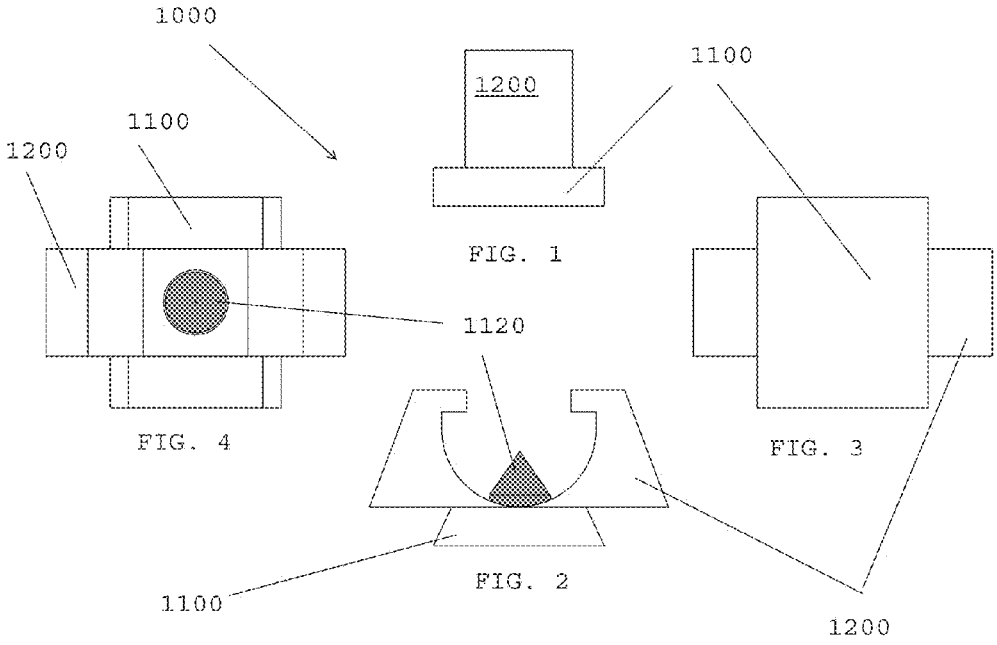
FIG. 1
FIG. 4
FIG. 3
FIG. 2
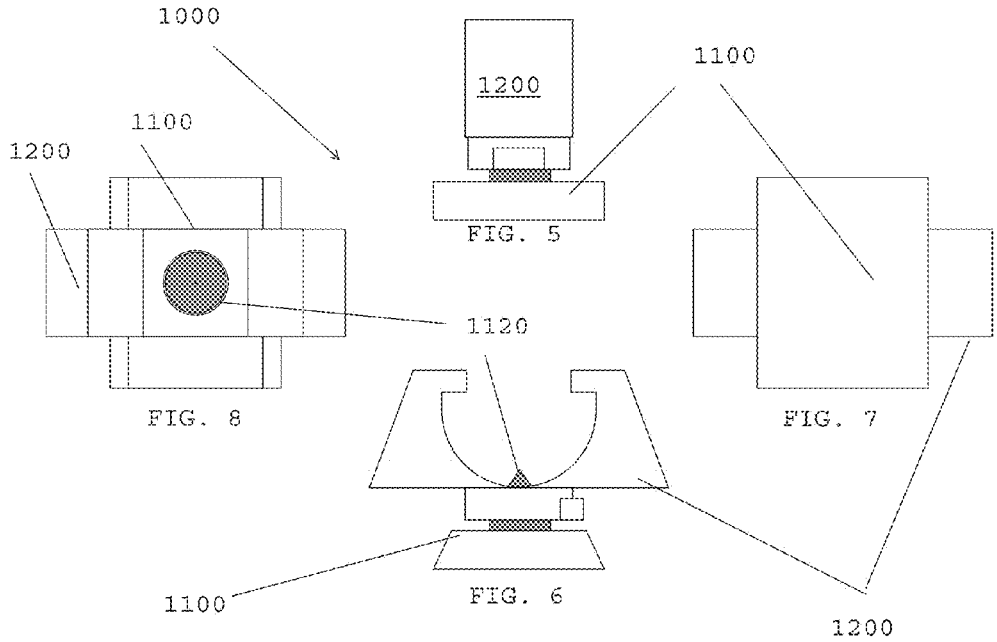
FIG. 5
FIG. 8
FIG. 7
FIG. 6

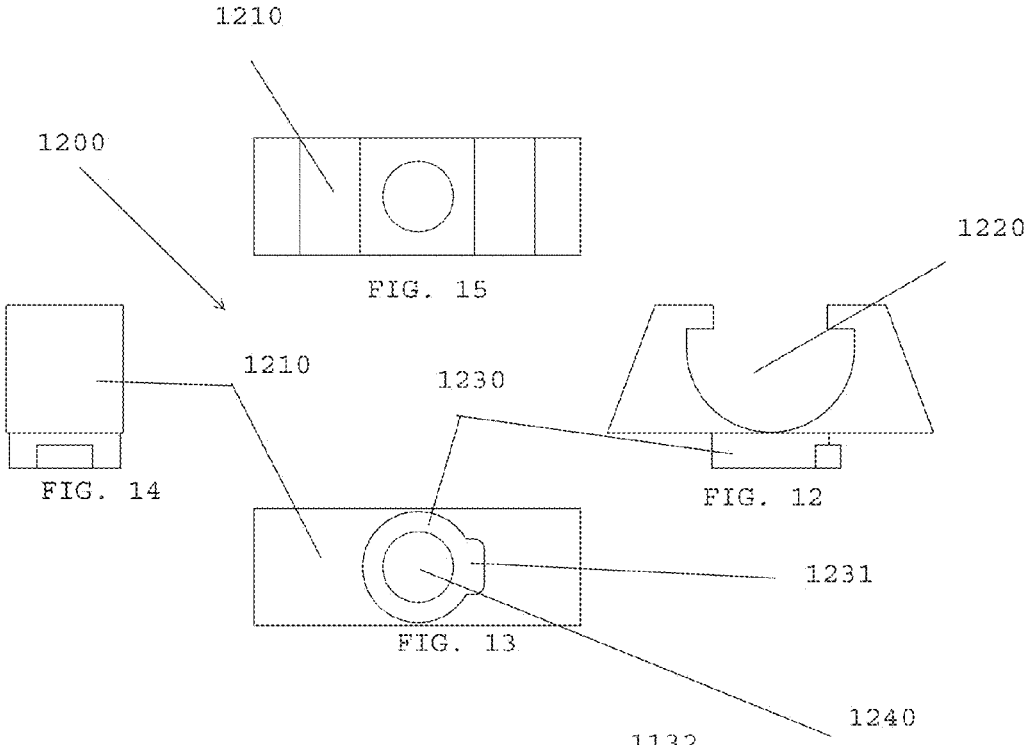
FIG. 15
FIG. 14
FIG. 12
FIG. 13
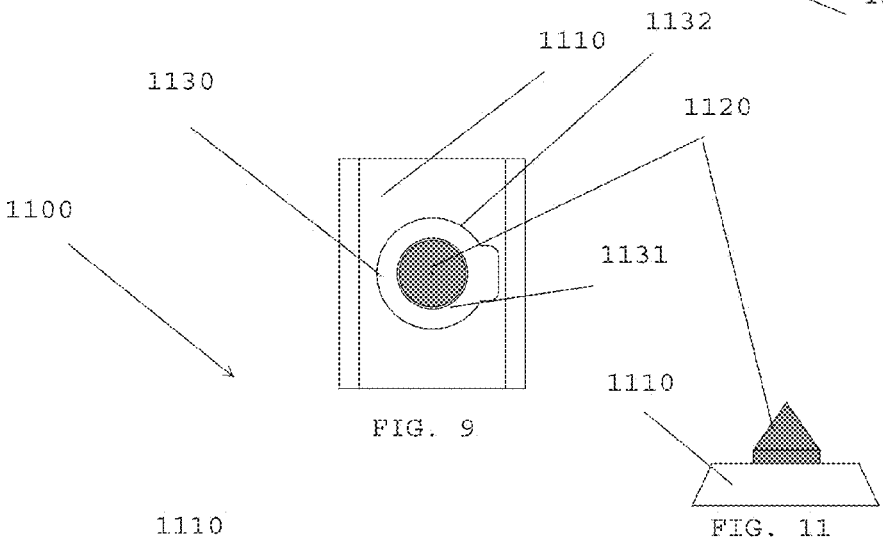
FIG. 9
FIG. 11
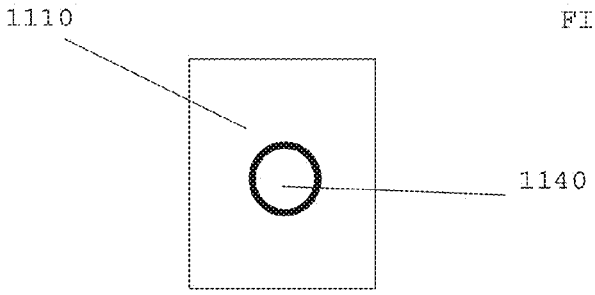
FIG. 10

PATRIDGE SIGHTS AND RELATED METHODS

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

1. Field of Invention

This application is in the field of improved open-sights and related methods.

2. Background of the Invention

Generally, open-sights are alignment markers used for aiming firearms or other projectile based weapons (collectively "weapons"). Open sights are comprised of a forward sight and a rear sight which provide horizontal and vertical references so that the same may be aligned to ensure that a weapon is properly trained toward a target. For firearms, the forward sight may be a post at the front end of a barrel and the rear sight is typically a notch or peephole at the rear end of the barrel. In many instances, open-sights are operated via aligning the forward and rear sights along a line of sight of a user.

The most common species within the genus of open sights are called "Patridge sights." The rear sight of a Patridge sight is typically defined by an opaque block that (a) is disposed crosswise at the back end of a weapon (e.g., at the rear end of a rifle barrel) and (b) features a central notch through its midsection. The forward sight of a Patridge sight is typically defined by a post that is located at a front end of the weapon (e.g., at the front-end of a rifle barrel). Patridge sights are generally operated by aligning the post of the forward sight with the notch of the rear sight. Specifically, proper sighting of a Patridge sight occurs when: (i) the top of the forward sight's post aligns with the top of the rear sight's block for vertical alignment (i.e., up-to-down alignment) of the weapon; (ii) the forward sight's post is centered in the notch of the rear-sight's block for horizontal alignment (left-to-right alignment) of the weapon; and (iii) (a) a target is viewably positioned above the vertically and horizontally aligned forward and rear sights for directional alignment of the weapon toward the target ("six-O'clock sighting") or (b) with the post of the front sight is superimposed at the center of the target ("split-the-target sighting"). Variations of Patridge sights exist, but usually operate in the same general manner (i.e., via the horizontal and vertical alignment of the forward sight with a central and vertical reference of the rear sight's notch plus directional alignment of the forward sight with a target).

Patridge sights are considered by some to be optimal in circumstances that require either quick short-range targeting or minimal occlusion of the view of a target. Patridge sights are optimal at short distances because exact sighting is less important for hitting a short-range target and operation of the sight involves simple alignment of the post and notch. Patridge sights are optimal for circumstances requiring minimal occlusion of the view of the target because the forward and rear sights are, in six-O'clock sighting, not positioned over the target during directional alignment of the target and weapon (instead, vertically and horizontally aligned forward and rear sights are viewably positioned beneath the target for directional alignment of the weapon and target). However, Patridge sights and related variations thereof are not always satisfactory for use as weapon sights in circumstances that require accurate and speedy targeting of a long-range target. Such sights are thought unsatisfactory in said circumstances because: (a) accurate vertical and horizontal alignment of said sights requires accurate estimation of horizontal and vertical alignment of the forward sight's post with the rear sight's notch plus accurate directional alignment of the weapon and target; and (b) because accurate and speedy mental estimation of those parameters requires a significant amount of training and practice. Accordingly, a need exists for enablement of accurate and speedy short or long-distance targeting on weapons equipped with Patridge sights.

Other species of the open sight genus exist which enable accurate and speedy weapon aiming. For example, U.S. Pat. No. 7,451,566 (issued Nov. 18, 2008) discloses a lateral-point alignment system, i.e., an open sight system of visual references which comprises a target point and corresponding lateral points on the forward or rear sights, wherein aiming is accomplished by visually touching the forward and rear lateral points while superimposing the target point on a target. Id., col. 3:41 through 53. Such lateral-point sighting system theoretically allow accurate aiming without difficult estimations of the vertical, horizontal, and directional alignment of the citing components. Id. The system's increased speed and accuracy over long-range sighting using Patridge sights is embodied in the sighting system's idiom of operation: "touch the points, pull the trigger" (note: the points do not physically touch). Id., col. 44 and 45.

Although generally speedy and accurate at long ranges, operation of lateral-point sighting systems is not always optimal. For instance, lateral-point systems are not entirely satisfactory in circumstances requiring a clear view of a target because such systems involve the superimposition of a target point and target so that, as a result, such systems inherently obstruct the view of the sighted target. For another instance, lateral point systems are sub-optimal in high-pressure situations (e.g., circumstances which require life-or-death targeting) because accurately touching tiny lateral points while superimposing a target point on a target is extremely difficult while under mental duress. Thus, a need exists for improvements to lateral-point sights.

In view of the foregoing, circumstances may arise wherein Patridge sights are favorable to Lateral-point sights or vice versa. However, Patridge sights are not simply interchangeable with point-on-point sights given the differences in the configuration of forward sights (compare: forward lateral-points vs. a forward post), the configuration of rear sights (compare: rear lateral points vs. a rear notch through a block), and the mode of operation (compare: the touching of a forward point and a rear point plus superimposition of a target point and a target vs. the vertical, horizontal and directional alignment of a post, a notch, and a target). Accordingly, there is a need for open sighting systems that readily operate as one of multiple sighting systems.

SUMMARY OF THE INVENTION

An object of this disclosure is to describe sighting systems that are readily operable according to more than one sighting system. In one embodiment, the system is a Patridge sighting system that is convertible or transformable into an improvement over lateral-point sighting systems called a point-on-point sighting system. More specifically, a preferred described embodiment is a sighting system that comprises: a forward sight defined by a post, wherein the post may be electively manipulated to reveal a pointed vertical rod; and a rear sight defined by a notched block, wherein the notched block may be opened to reveal a horizontal pointed rod. In one mode of operation, the sighting system may be operated by vertically and horizontally aligning the post and notch and by directionally aligning the post, the block, and a target. In another mode of operation, the sighting system may be operated by opening the post to reveal the pointed vertical rod, opening the block to expose the horizontal pointed rod, and superimposing the points of the pointed horizontal and vertical rods over a target. In one mode of operating, the vertical pointed rod is revealed via hinging the post away from an initial position over the pointed rod. In another mode of operation, the vertical pointed rod is revealed via twisting the post so that a window through the rod is inline with the rear sight of the system. In yet another mode of operation, the horizontal rod is exposed via dividing the notched block so that the pointed rod is provided therein the divide.

Other objectives and desires may become apparent to one of skill in the art after reading the below disclosure and viewing the associated figures.

BRIEF DESCRIPTION OF THE FIGURES

The manner in which these objectives and other desirable characteristics can be obtained is explained in the following description and attached figures in which:

FIGS. 1 through 4 respectively depict left (or right), front (or back), bottom, and top views of the forward sight 1000;

FIGS. 1A through 4A respectively depict left (or right), front (or back), bottom, and top views of an alternate embodiment of the forward sight 1000;

FIGS. 5 through 8 respectively depict the same views depicted in FIGS. 1 through 4 of another configuration of the forward sight 1000, wherein the post 1200 of the forward sight 1000 is rotated by ninety degrees relative to the base 1100;

FIGS. 5A through 8A respectively depict the same views depicted in FIGS. 1A through 4A of another configuration of the alternate embodiment of the forward sight 1000, wherein the post 1200 of the forward sight 1000 is rotated by ninety degrees relative to the base 1100;

FIG. 9 is a top view of a base;

FIG. 10 is a bottom view of the base;

FIG. 11 is a view of the front or back and left or right side of the base;

It is to be noted, however, that the appended figures illustrate only typical embodiments of the disclosed sighting systems, and therefore, are not to be considered limiting of their scope, for the disclosed systems may admit to other equally effective embodiments that will be appreciated by those reasonably skilled in the relevant arts. Also, figures are not necessarily made to scale.

DETAILED DESCRIPTION OF PREFERRED EMBODIMENTS

Disclosed are sighting systems that may be readily operable as both point-on-point and Patridge sighting systems. Generally, the disclosed sighting system is a Patridge sighting system that is convertible or transformable into a point-on-point sighting system and vice-versa. The system features: a forward sight at the front of a weapon, wherein said forward sight is defined by a post with a concealed and vertically oriented pointed rod; a rear sight at the back of the weapon, wherein the rear sight is defined by a notched block with a concealed and horizontally oriented pointed rod. In an alternate embodiment, the forward sight has a horizontally oriented pointed rod instead of a vertical oriented pointed rod and the rear sight has a vertically oriented pointed rod instead of a horizontally oriented pointed rod. The more specific aspects of the system are best disclosed with reference to the attached drawings.

FIGS. 1 through 8 depict a preferable embodiment of a forward sight 1000. FIGS. 1 through 4 respectively depict left (or right), front (or back), bottom, and top views of the forward sight 1000. As shown in the figures, the forward sight 1000 is generally defined by a base 1100 and a post 1200. FIGS. 5 through 8 respectively depict the same views depicted in FIGS. 1 through 4 of another configuration of the forward sight 1000, wherein the post 1200 of the forward sight 1000 is being inserted into the base the base 1100. Referring collectively to FIGS. 1 through 8: the 1100 base is depicted as a block 1110 with an upstanding and coaxial pointed rod 1120; the post 1200 is a block 1210 with a window 1220 therethrough; wherein the post 1200 is rotably mounted to the top of the base 1100.

Figure 9A:
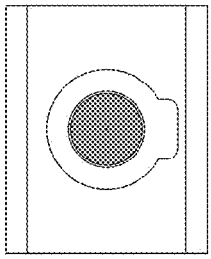
FIG. 9A is a top view of the post 1200.
Figure 11A:
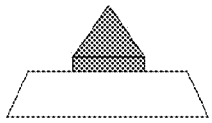
FIG. 11A are respectively a view of the front or back and left or right side.
Figure 10A:
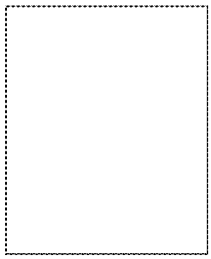
FIG. 10A is a bottom view of the post.

FIGS. 9 through 11 depict the base 1100 of the forward sight 1000, wherein: FIG. 9 is a top view; FIG. 10 is a bottom view; and, FIG. 11 is a view of the front, back, left, or right side. Referring to said figures collectively, the base 1100 is preferably defined by the block 1110 (defined by a six-sided prism in the form of a dovetail for a dovetail and rail connection), the coaxial and upstanding pointed rod 1120, a key receptacle 1130 disposed into the top of the block 1110 and around the upstanding pointed rod 1120, and an attachment means 1140 (e.g., a threaded socket for receiving a threaded member in the manner of a nut and bolt system) disposed on the bottom of the block 1110. The more specific details of the key receptacle 1130 will be discussed below in connection with the key 1230 of the post 1200.

FIGS. 12 through 15 depict the post 1200. Specifically, FIGS. 12 through 15 respectively depict front or back, bottom, left or right, and top views of the post 1200. As shown in the figures, the post 1200 is preferably defined by the block 1210 (or six-sided prism), the coaxial window 1220 through the block 1210, the key 1230 that projects coaxially from the bottom of the block 1210, and the rod receptacle 1240 that extends coaxially through the key 1230 into the window 1220 of the block 1210.

Figure 1A:
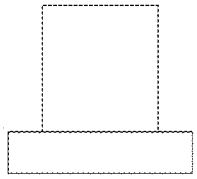
Figure 4A:
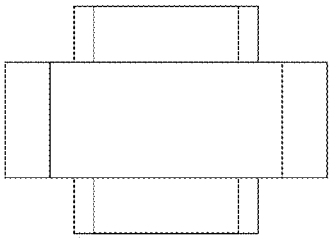
Figure 3A:
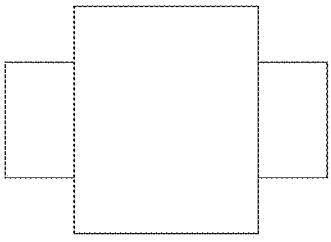
Figure 2A:
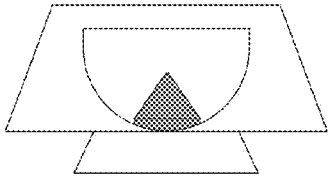
Figure 5A:
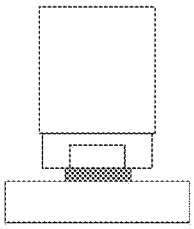
Figure 8A:
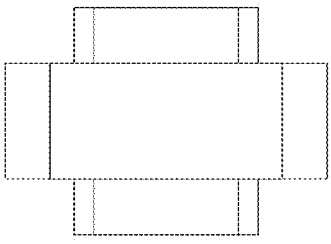
Figure 7A:
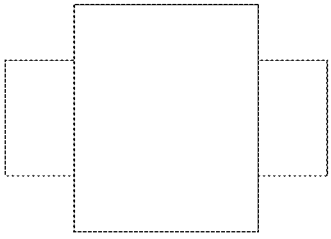
Figure 6A:
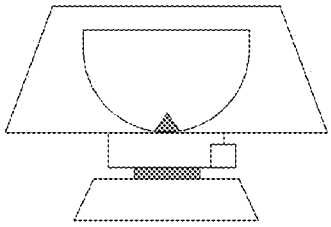
Figure 15A:
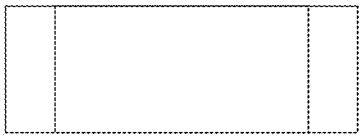
FIGS. 12 through 15 respectively depict front or back, bottom, left or right, and top views of a base.
Figure 14A:
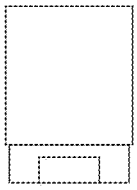
Figure 12A:
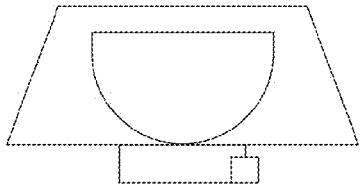
Figure 13A:
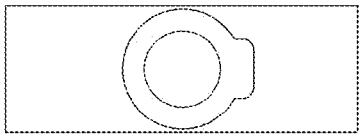

As mentioned above, the post 1200 may be rotably mounted to the base 1100 in order to construct the forward sight 1000. Said rotable mount of the base 1100 and post 1200 is accomplished via insertion of the key 1230 into the key receptacle. To wit, the key 1230 of the post 1200 is configured for rotable insertion into the key receptacle 1130 of the base 1100. Referring to FIG. 13, the key 1230 is preferably a tubiform cylinder with a digit 1231 extending outwardly from the outer surface of the cylinder. Correspondingly, the key receptacle 1130 is a cylindrical bore 1131 around the upstanding rod 1120 whereby the key 1230 may be inserted to the bore 1131 while the upstanding pointed rod 1120 inserts through the key 1230 into the window 1220 of the post 1200. Suitably, the bore 1130 may feature a first tier 1132 wherein the key 1230 may freely rotate on interface of the digit 1231 and tier 1132. As discussed below in connection with operation of the forward sight 1000, the first tier 1132 of the key receptacle 1130 may suitably feature two notches 1133, separated by ninety degrees around the first tier 1132, wherein the digit 1231 may enter one of the two notches 1133 to lock the post 1200 in one of the two configurations of the forward sight depicted in FIGS. 1 through 8.

Figures 16, 17, 18, 19, 20, 21:
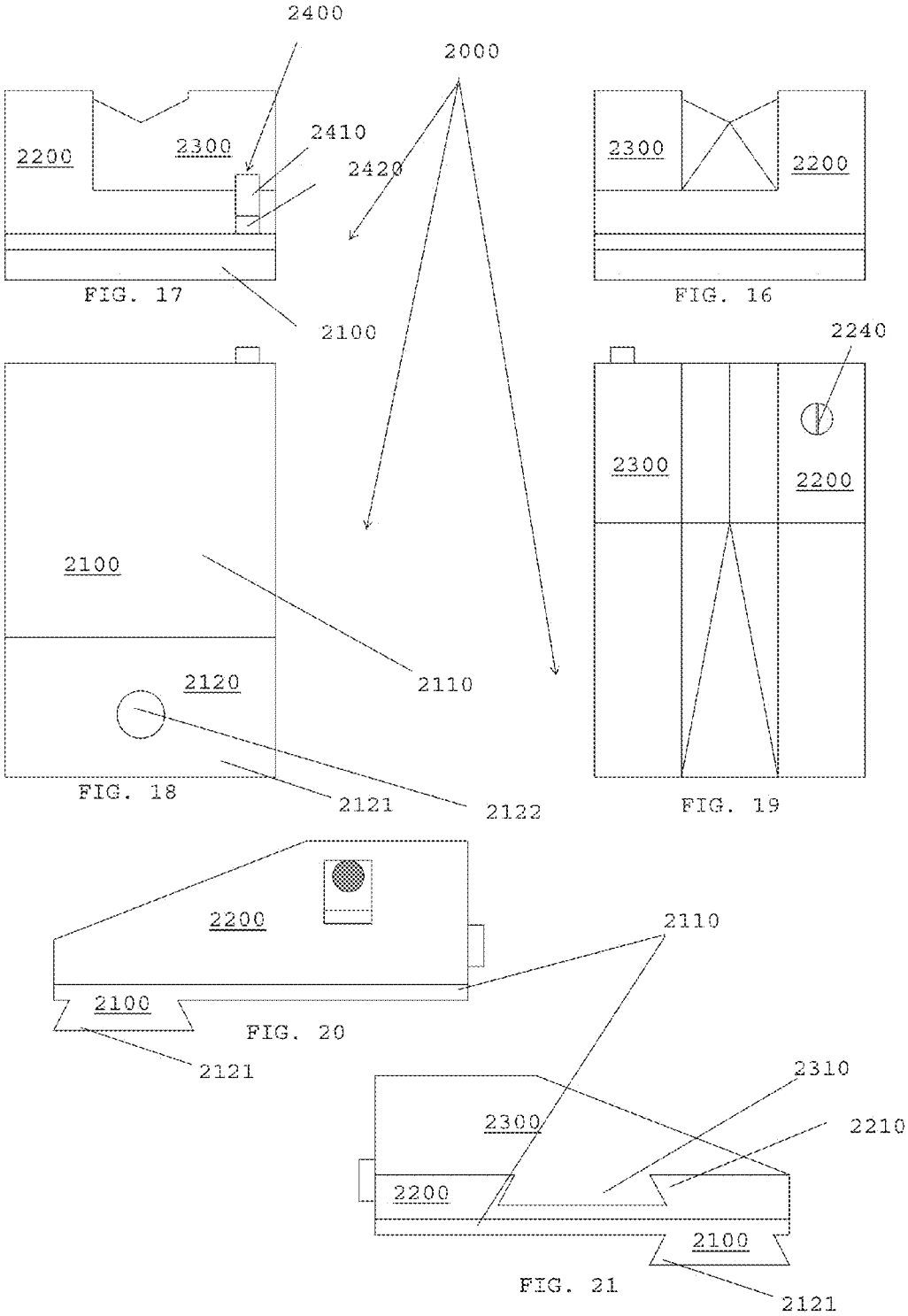
FIGS. 16 through 21 respectively depict back, front, bottom, top, left, and right side views of the rear sight 2000.
Figure 23:
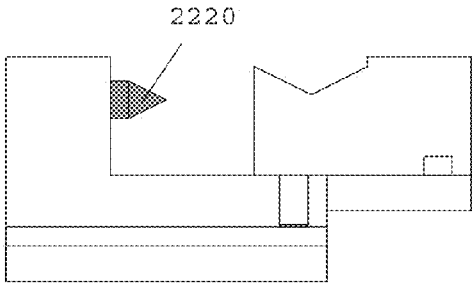
FIGS. 22 through 27 respectively depict the same views depicted in FIGS. 16 through 21 of another configuration of the rear sight 2000, wherein the slidable upright 2300 is further separated on the base 2100 from the stationary upright 2200.
Figure 22:
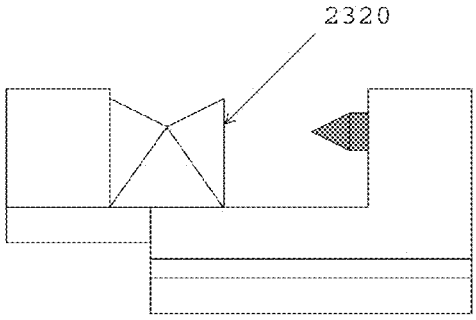
Figure 24:
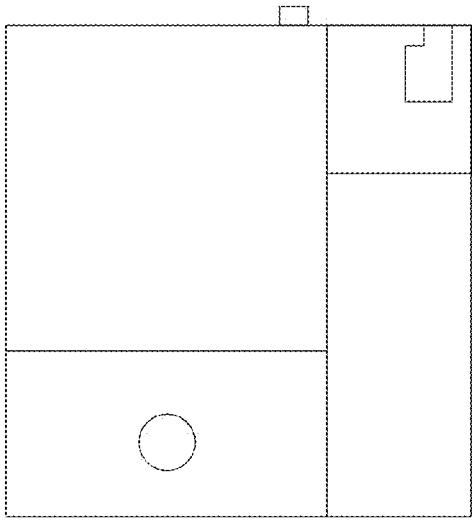
Figure 25:
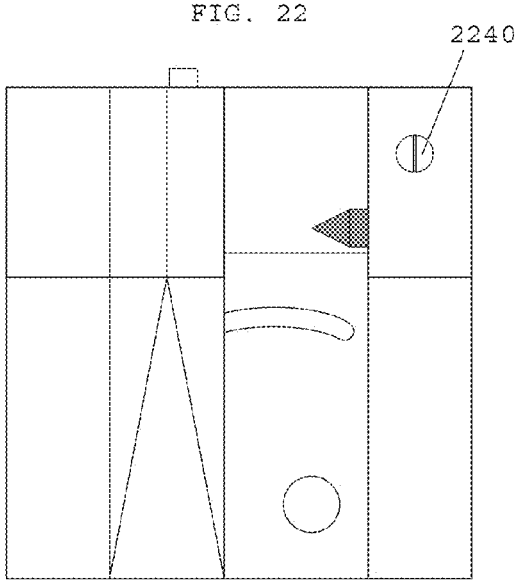
Figure 26:
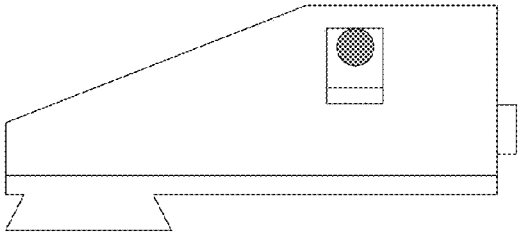
Figure 27:
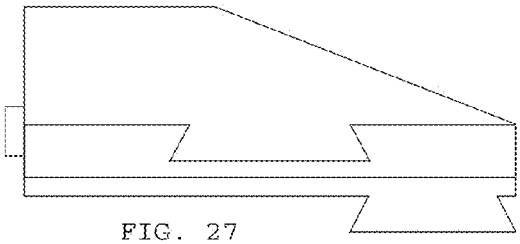

FIGS. 16 through 27 depict a preferred embodiment of the rear sight 2000. More specifically: FIGS. 16 through 21 respectively depict front, back, bottom, top, left, and right side views of the rear sight 2000. As shown in the figures, the rear sight 2000 is generally defined by a base 2100 with a stationary upright 2200 and a slidable upright 2300. FIGS. 22 through 27 respectively depict the same views depicted in FIGS. 16 through 21 of another configuration of the rear sight 2000, wherein the slidable upright 2300 is further separated on the base 2100 from the stationary upright 2200. Referring to FIGS. 18, 19, and 21, the base 2100 is preferably defined by a platform 2110 and an attachment means 2120. In one embodiment, the platform is a rectangular prism and the attachment means is a dovetail 2121 plus threaded receptacle 2122 for a threaded male member (e.g., a threaded socket for receiving a threaded member in the manner of a nut and bolt system). In the closed configuration shown in FIGS. 16 through 21, the uprights 2200, 2300 generally form a Patridge sight on the base. More specifically the uprights 2200, 2300 in those figures define a slanted block with a notch 2310. Referring to FIGS. 16, 17, 19 through 23, 25 and 27, the slidable upright 2300 is generally disposed in a rail 2210 (shown as a dovetail 2310 and rail 2210) extending over the base 2100 from the stationary upright 2100 whereby the slidable upright 2300 may be moved relative to the stationary upright 2200 to an open configuration depicted in FIGS. 22 through 27. In one embodiment the rear sight 2000 is biased toward an open configuration and, so that the rear sight 2000 may be closed, features a switch 2400. As shown the switch is a depressible digit 2410 that may be inserted into a nook 2420 in the surface of the movable upright 2300 to lock closed the rear sight 2000. Suitably the locked upright may be unlocked to an open configuration via depressing the digit 2410 so that it no longer interfaces with the nook 2420. As discussed in greater detail below, whenever the slidable upright 2300 is moved away from the stationary upright 2200 via the rail 2210 to an open configuration, a horizontally extending pointed rod 2220 extends from the stationary upright 2200 toward the slidable upright 2300 as shown in FIGS. 22, 23, and 25. Also discussed in greater detail below is the adjusting mechanism 2500 shown in FIGS. 19 and 25.

As disclosed above, a horizontally extending rod 2220 may extend from the stationary upright 2200 whenever the rear sight is in an open configuration. In at least one embodiment of the disclosed sighting system, the horizontally extending rod 2220 may structurally conflict with the notch 2310 of the sliding upright 2300 when the rear sight is closed. In a preferred embodiment, two alternative mechanisms may be provided to resolve said structural conflict. These mechanisms are disclosed below in turn.

Figure 28:
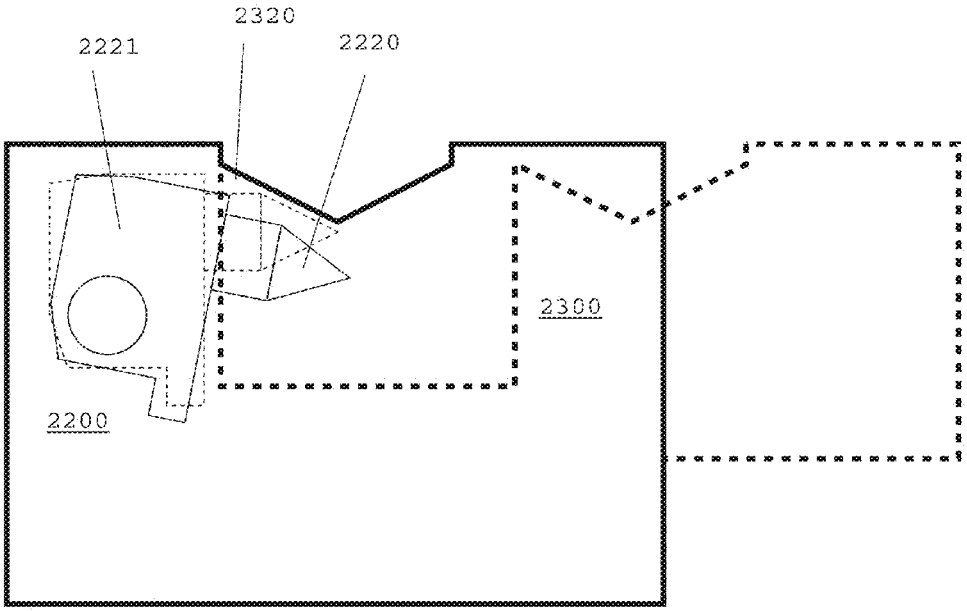
FIGS. 28 and 29 respectively depict a silhouette of a closed and open rear sight.
Figure 29:
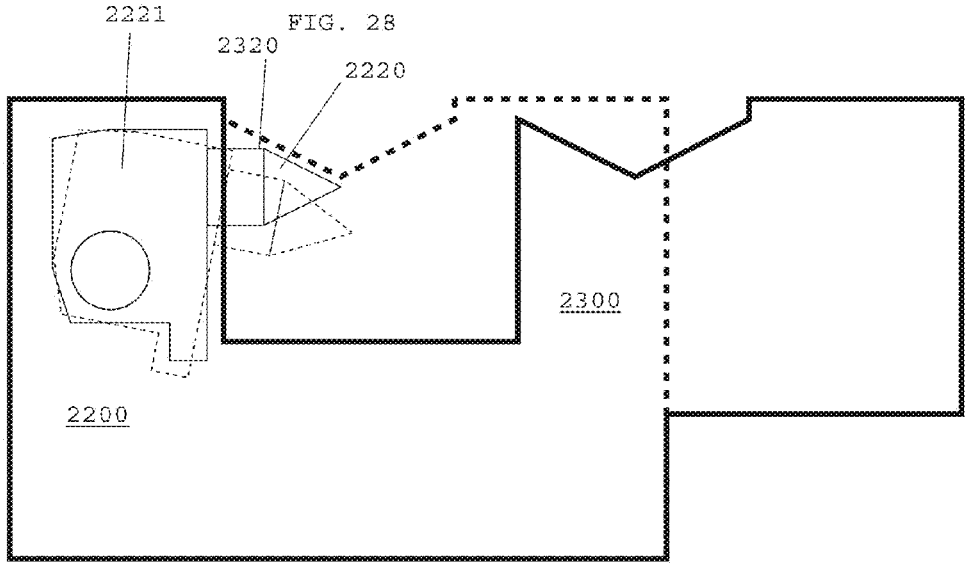

FIGS. 28 and 29 respectively depict a silhouette of a closed and open rear sight. As shown, the stationary upright 2200 may feature an internal pivot block 2221 and the slidable upright 2300 may feature an angled rod receptacle 2320 whereby the rod 2200 folds toward the stationary upright 2200 while inside of the receptacle 2320. Referring still to FIGS. 28 and 29, the rod receptacle 2320 may feature an angled surface for deflecting the rod 2220 in the pivot block 2221 during closing of the rear sight 2000 via interaction between the rod and the angled surface of the rod receptacle. Other mechanisms for accomplishing downward deflection of the rod 2210 may also be provided in different embodiments. For example, a spring may be provided for pivoting the rod when the rear sight 2000 is closed. Other of such mechanisms will be readily apparent to those of skill in the art after reading this disclosure.

Figure 30:
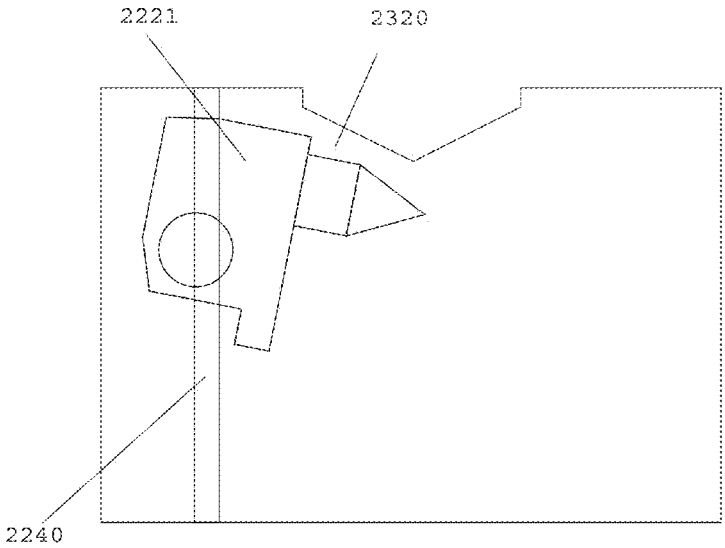
FIGS. 30 and 31 respectively depict a silhouette of a closed and open rear sight.
Figure 31:
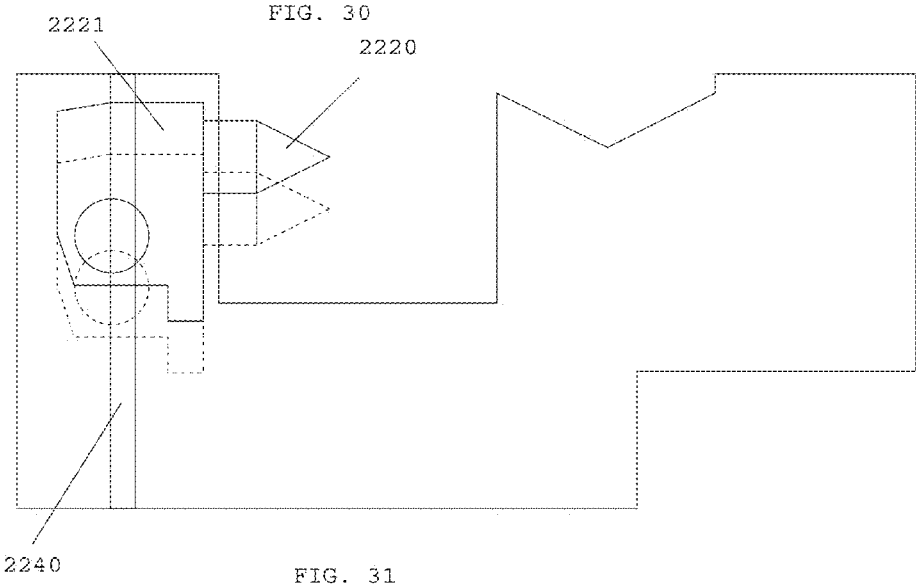

FIGS. 30 and 31 respectively depict a silhouette of a closed and open rear sight. As shown, the figures plus FIG. 25 illustrate another mechanism for resolving the structural conflict of the horizontally oriented pointed rod 2220 and the notch 2320 of the slidable upright 2300 while the rear sight 2000 is closed. Referring to FIGS. 19, 25, 30 and 31, the stationary upright 2200 preferably features a threaded adjustment shaft 2240 for raising or lowering the pivot block 2221 via corresponding threads on a block to which the pivot block 2221 is pivotally attached. Suitably, the adjustment shaft 2240 may be fixedly disposed within the stationary upright so that turning the shaft moves the pivot block up or down within the stationary upright 2200. As shown in FIG. 31 the rod 2220 may be lowered to avoid conflict with the notch, as shown in FIG. 30. As discussed below, the adjustment shaft 2240 may further be employed for calibrating the disclosed sighting system.

Figure 32:
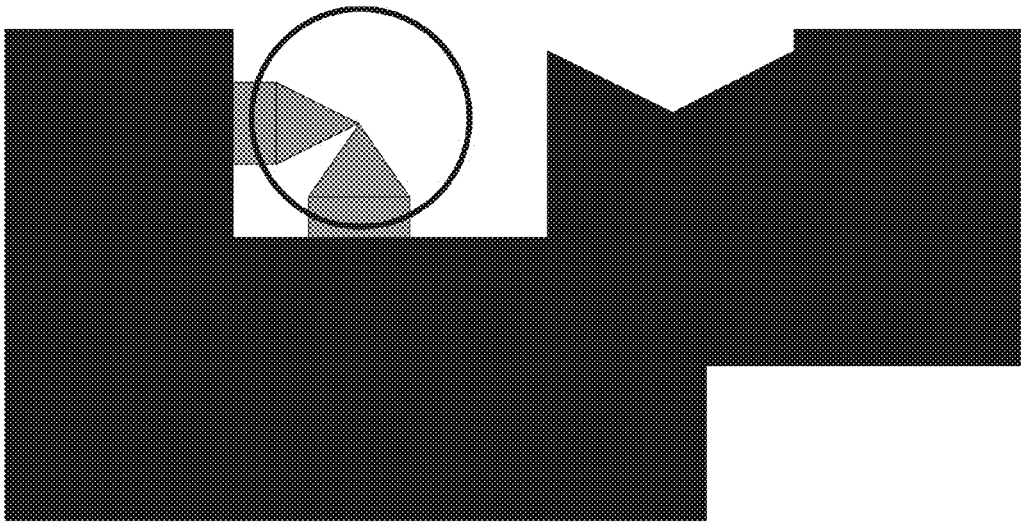
FIG. 32 illustrates the silhouette of an open rear sight 2000 as aligned with the front sight 1000 in the manner of a point-on-point sight; and, FIG. 33 depicts the silhouette of a closed rear sight 2000 as aligned with the front sight 1000 in the manner of a Patridge sight.
Figure 33:
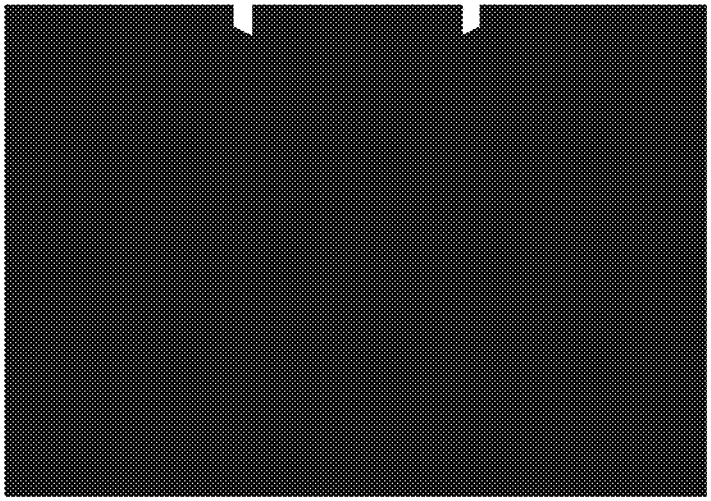

As alluded to above, the disclosed sighting system may be used to quickly transform the sighting of a weapon from a Patridge sight to a point-on-point sight. FIG. 33 depicts the silhouette of a closed rear sight 2000 as aligned with the front sight 1000 in the manner of a Patridge sight. To arrive at the shown alignment, the post 1200 (FIGS. 1 through 8) may initially be rotated until the window 1220 is directed perpendicular to the rear sight 2000. Suitably, the front sight may be locked in position via one of said notches in the first tier 1131 of the base 1100. When so configured, the sighting system may be operated as a Patridge sight. FIG. 32 illustrates the silhouette of an open rear sight 2000 as aligned with the front sight 1000 in the manner of a point-on-point sight. To arrive at the illustrated alignment, the post 1200 (FIGS. 1 through 8) may initially be rotated until the window 1220 is directed toward the rear sight 2000. When so configured, the sighting system may be operated as point to point sight.

The disclosed sighting system may be constructed of any suitable materials and methodologies known for the construction of weapon sighting systems. It should be noted that FIGS. 1 through 33 and the associated description are of illustrative importance only. In other words, the depiction and descriptions of the present disclosure should not be construed as limiting of the subject matter in this application. Additional modifications may become apparent to one skilled in the art after reading this disclosure.

I claim:

1. A method of sighting a target comprising the steps of:

obtaining a firearm with an open sight defined by a forward sight and a rear sight;

transforming the open sight to a point-on-point sight by (a) manipulating the forward sight to expose a first point and (b) manipulating the rear sight to expose a second point; and, superimposing the first and second points on a target.

2. A method of claim 1 wherein:

the forward sight is defined by a post that (i) internally features the first point and (ii) features a window for viewing the first point;

the rear sight is defined by a stationary upright and a slidable upright wherein moving the slidable upright relative to the stationary upright exposes the second point;

exposing the first point of the forward sight is accomplished via rotating the post so that the window is directed toward the rear sight; and, exposing the second point of the rear sight is accomplished via moving the slidable upright relative to the stationary upright.

3. The method of claim 2 further comprising the step of:

transforming the point-on-point sight the open sight by (a) manipulating the forward sight to hide the first point and (b) manipulating the rear sight to hide the second point; and, aligning the forward sight with the rear sight.

4. The method of claim 3 wherein:

the forward sight is defined by a post that (i) internally features the first point and (ii) features a window for viewing the first point:

the rear sight is defined by a stationary upright and a slidable upright wherein moving the slidable upright relative to the stationary upright hides the second point;

hiding the first point of the forward sight is accomplished via rotating the post so that the window is directed away from the rear sight; and, hiding the second point of the rear sight is accomplished via moving the slidable upright relative to the stationary upright.

* * * * *